United States Patent [19]

Paulus et al.

[11] 4,349,393

[45] Sep. 14, 1982

[54] CONTINUOUS HEAT TREATMENT FOR METAL SHEET

[75] Inventors: Philippe Paulus; Marios Economopoulos, both of Liege, Belgium

[73] Assignee: Centre de Recherches Metallurgiques-Centrum Voor Research in de Metallurgie, Brussels, Belgium

[21] Appl. No.: 187,728

[22] Filed: Sep. 16, 1980

[30] Foreign Application Priority Data

Sep. 21, 1979 [BE] Belgium ..... 878944

[51] Int. Cl.[3] ..... C21D 9/48

[52] U.S. Cl. ..... 148/142; 148/12 C; 148/12.3; 148/156

[58] Field of Search ..... 148/13, 13.1, 143, 155, 148/156, 142, 153, 12 C, 12 D, 12.3, 12.4

[56] References Cited

U.S. PATENT DOCUMENTS 3,052,014 9/1962 Falcon ..... 148/13.1

OTHER PUBLICATIONS

"Compact Furnace Anneals Strip", from The Iron Age, Feb. 26, 1959.

"Lines Anneal Fast without Soaking", from Steel, Oct. 14, 1957.

*Primary Examiner*—R. Dean

*Attorney, Agent, or Firm*—Holman & Stern

[57] ABSTRACT

Metal sheet (cold-rolled steel sheet) contaminated with rolling oil is heated at a temperature higher than its recrystallization temperature in a naked flame furnace, e.g. of the incomplete combustion type. The heated sheet is then rapidly cooled by contact with an aqueous medium. The resulting sheet has considerably improved suitability for phosphate coating and painting, compared with sheet which is annealed after alkaline degreasing. The sheet is preferably treated with formic acid.

11 Claims, 1 Drawing Figure

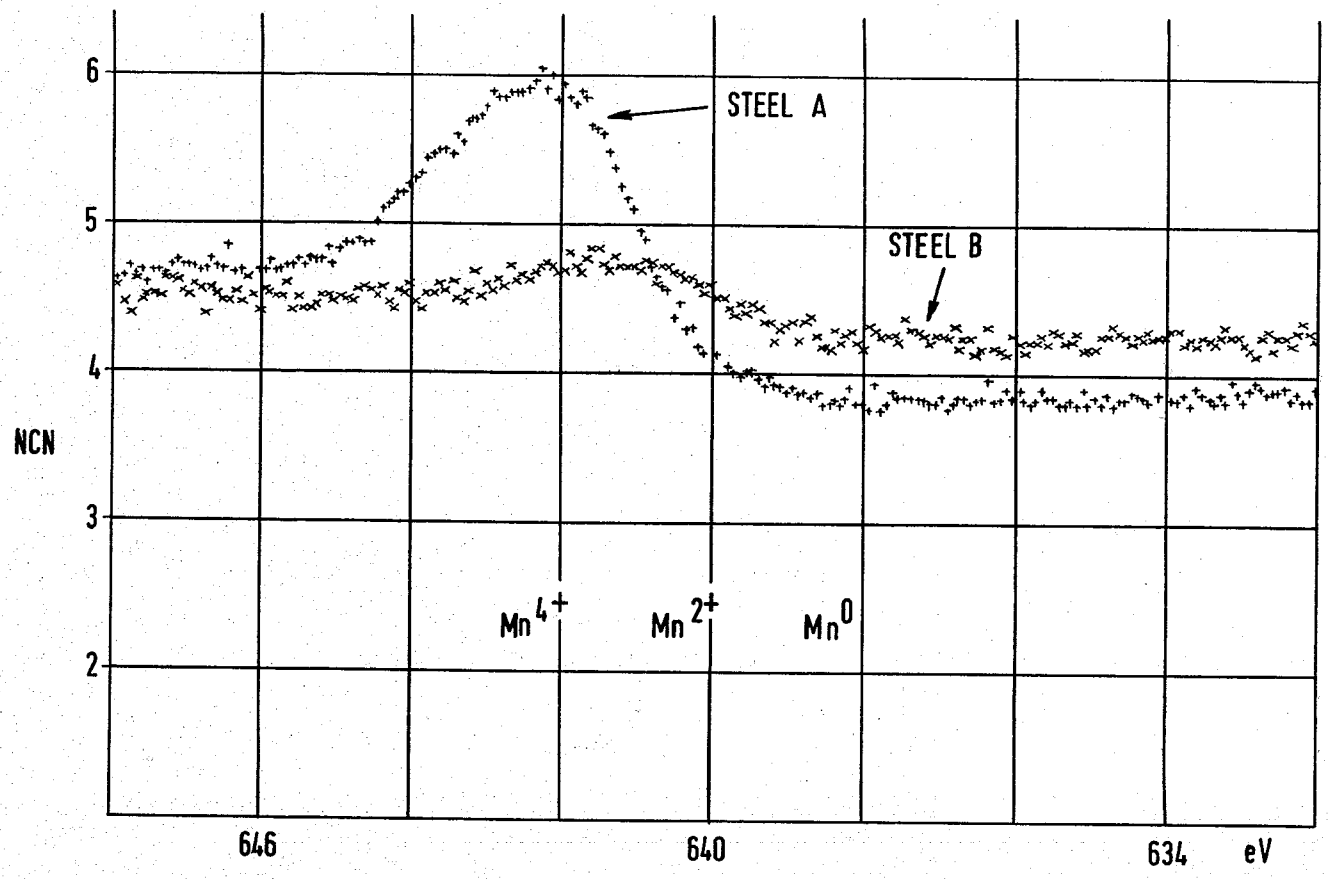
STEEL A
STEEL B
$Mn^{4+}$
$Mn^{2+}$
$Mn^{0}$
NCN
6
5
4
3
2
646
640
634
eV

CONTINUOUS HEAT TREATMENT FOR METAL SHEET

BACKGROUND OF THE INVENTION

1. Field of the Invention

The present invention relates to a method of continuous heat treatment designed to improve the quality of the surface of the sheet, in particular cold rolled steel sheet.

2. Description of the Prior Art

In industrial practice, cold rolled steel sheet is obtained (after preparation of the steel and hot rolling of the strand or slab) by pickling of the hot-rolled strip followed by cold rolling to the required thickness and finally by annealing in order to restore the mechanical properties of the steel and by a skin-pass to provide the steel with the required final surface finish and to remove the yield plateau of the tensile test curve.

All the operations following hot rolling have an effect on the final surface condition of the sheet. Thus, inadequate rinsing after pickling may provide the possibility of subsequent contamination. In the same way, the selection of the rolling oil is extremely important to the extent that this oil may not be removed from the surface of the sheet if the annealing process is not suitably adapted to this.

Several authors have given sufficient proof of the fact that the surface cleanness of steel sheet (more particularly the amount of carbon deposited) is an important parameter in explaining the suitability of this sheet for phosphate coating and its resistance to corrosion by salt spray after painting. Such surface cleanness may be tested in several ways, for example by the adhesive tape test in which transparent adhesive tape is applied to the surface of the sheet and then removed with possible deposits taken from the sheet. It is possible to measure the absorption of the light passing through the tape and therefore to quantify the surface deposits on the sheet. A method of this type provides a measurement of the amounts of deposits of all types on the surface, for example, dust, carbon traces, filings, etc.

A further method of testing the surface quality, which is also extremely widespread, consists in quantifying the total amount of carbon present on the surface of the steel. This involves washing the surface of the sheet with hydrochloric acid by means of pads of inorganic material which is then "burnt" with oxygen and the amount of $CO_2$ released is measured. It is therefore possible to measure the total amount of carbon present in various forms on the surface of the steel in $mg/m^2$. It is also possible, for the purpose of standardizing tests, to utilize a power wash (with jets) before the hydrochloric acid washing in order to remove possible protective oils and to bring the sheet into the condition which it possesses after shaping and before phosphate coating and final painting. This is the case in the well-known as the "Ford test."

Further means of analysing the surface of steel are provided by the ion microanalyser, the Auger spectrometer, etc. These enable detection of all the chemical elements on the surface and the development of their concentration as a function of depth.

These techniques enable the detection of possible contamination by elements other than iron, these elements possibly being a result of the baths used (washing, pickling, rinsing, degreasing) or possibly being due to the steel itself.

As stated above, it is known at present that surface carbon on steel impairs resistance to corrosion by salt spray applied to the painted sheet. This carbon is deposited chiefly by the rolling oil. In current practice, the rolling oil is not removed from the surface of the sheet after rolling, but is evaporated during batch annealing. However, when the amount of surface carbon is measured after annealing of this type, it is possible to observe considerable contamination which leads to unfavorable phosphate coating and painting (exposure to salt spray) results.

Considerable progress has been made by subjecting the product to continuous annealing preceded by degreasing, for example by electrolysis in a solution of sodium orthosilicates.

In the case of simple continuous annealing, heating is in effect carried out under an $N_2/H_2$ atmosphere and the oil does not have the time to evaporate, as the heating is very rapid. On the other hand, in several known methods, continuous annealing is preceded by a degreasing operation which is effected, in the majority of cases, in an alkaline medium. As the rolling oil has been eliminated before the sheet is placed in the furnace, the surface cleanness is considerably greater, in particular in respect of the total amount of surface carbon, which is decreased for example to 1 $mg/m^2$ to 8 $mg/m^2$ in the case of very clean sheet produced in a static furnace. However, as stated above, while such a decrease in the amount of surface carbon should, according to various authors, lead to an improvement in painting results, it has been observed that this improvement is not particularly great.

SUMMARY OF THE INVENTION

The object of the present invention is precisely to remedy this situation.

We have developed a method of applying continuous annealing with naked flame heating, of the type often used in the continuous galvanizing of steel strip, to sheet designed for automobile bodywork, and therefore designed for a double treatment of phosphate coating and painting. It is known that this type of heating is very suitable for the preparation of the surface for galvanizing, for which the basic requirement is the absence of any trace of oxides on the surface before immersion in the zinc bath. This type of heating has a greater or lesser oxidizing effect depending on the type of furnace used, and the possible oxide produced by passage through this furnace must be reduced by the hydrogen contained in the gas producing the atmosphere during the subsequent annealing-galvanizing steps.

The method of the invention is based on the surprising observation that non-degreased strip, i.e. strip on which the rolling oil is simply burnt off or evaporated in the naked flame furnace, has a considerably improved suitability for phosphate coating and painting in comparison with strip which is annealed after alkaline degreasing. Whilst carrying out this work, we have observed that, if combustion is controlled carefully, it is possible to produce an ultra-clean, non-oxidized strip which is highly resistant to salt spray after phosphate coating and painting. The examples given below elucidate this surprising effect further, this effect being due to the absence of the film of $SiO_2$ produced by degreasing in an alkaline bath before annealing, which film appears to retard the phosphate coating reaction.

DESCRIPTION OF THE PREFERRED EMBODIMENTS

The method of the present invention, in which metal sheet is subjected to a continuous heat treatment comprising a heating step and then a rapid cooling step, is essentially characterized in that the heating step is carried out at a temperature higher than the recrystallization temperature of the metal, and is applied to non-degreased sheet, i.e. sheet which is still coated with at least part of the rolling oil, and in that this heating is carried out, at least in its initial period, in a naked flame furnace, preferably of the incomplete combustion type, and in that the rapid cooling comprises a step in which the sheet is contacted with an aqueous medium, preferably at a temperature greater than 75° C.

It should be understood that, in the present specification, the expression "aqueous medium" does not only signify, in a limiting manner, a bath of water alone, but also covers any aqueous medium, saturated or not, containing matter in solution and/or in suspension for any required purpose. The aqueous medium may be provided in the form of a bath, jets of water, or mist sprays, separately or in combination, in any desired sequence.

The application of the method of the invention may, in addition, be adapted, according to requirements, to the various products to be treated.

Thus, in certain cases, the surprising effects of the treatment in a naked flame furnace of sheet which has not been degreased may be further improved. In respect, in particular, of its mechanical properties, the sheet may be subjected to a carbon precipitation phase at a temperature of between 200° C. and 500° C., following the rapid cooling.

In addition to this first improvement, which is itself considerable, of the surface quality of metal sheet, the method also comprises a further advantage.

It is known that during the heating of steel in an oxidising medium, certain elements contained in the steel, such as manganese, chromium, and phosphorus, which may be oxidised to a greater extent than iron, migrate towards the surface. This causes surface enrichment of the steel in certain elements, even if the steel only contains very low amounts of these elements. Thus, a mild steel containing 0.3% of manganese may, in an extreme case, have a surface content of manganese of approximately 15% after batch annealing, even if the annealing has been carried out under a protective atmosphere of $N_2/H_2$ having a low dew point and a low $O_2$ content. The residual $H_2O$ and $O_2$ contents of the gas are sufficient to attract the manganese towards the surface, and the very long duration (several hours) and high temperature (700° C.) of the process enable the phenomenon to become very marked.

In principle, the case of continuous annealing, the dwell time at a high temperature is considerably shorter (a few minutes) and therefore the surface contamination by other elements rising from the mass of the sheet should be considerably lower. We have, however, noted that the reduction of surface enrichment may only be obtained in the absence of alkaline degreasing, as the latter causes the formation on the surface of a film of residual silica which provides an oxidising potential causing the segregation of the alloying elements contained in the body of the sheet.

BRIEF DESCRIPTION OF THE DRAWING

The accompanying drawing is a graph of the photoelectron spectra of the surface of two steels.

The graph demonstrates that steel which is continuously annealed after alkaline degreasing has a considerable surface enrichment in manganese, whilst the same steel continuously annealed in a naked flame furnace and without preliminary degreasing only shows a slight increase in Mn content.

This graph (in which the number of electrons —NCN— is shown on the Y-axis and the bonding energy —eV— is shown on the X-axis) gives the standardised photoelectron spectra (ESCA) detected on the extreme surface of two continuously annealed mild steels, i.e. after alkaline degreasing before annealing (steel A) and with degreasing carried out in the naked flame furnace according to the method of the invention (steel B).

One observes a surprising decrease in Mn enrichment. In effect, the sheet obtained with the method of the invention had a greater resistance to atmospheric corrosion and to rust pitting during storage. An improvement of this type is very important, bearing in mind the considerable number of sheets which are usually rejected on delivery to the client owing to corrosion pits.

A particular operational embodiment of the method of the invention provides a further improvement of the surface quality. This embodiment comprises treatment in an acid medium, carried out during or after cooling. A treatment of this type enables the quasi complete elimination of any trace of surface contamination, whether resulting from the residual carbon, the rolling oil, or the residual enrichment in elements which have risen from the body of the steel.

An operation of this type may be advantageously carried out after an oxidising phase of the annealing: quenching in an aqueous medium or exposure for a limited duration to an oxidising gas. The removal of the slight oxide film resulting from this step enables hitherto unequalled surface contamination levels to be obtained. The acid used may advantageously be an organic acid, preferably based on or consisting of formic acid. The acid treatment may be advantageously carried out after the rapid cooling or after final cooling.

The following example shows the result of a step of this type following a treatment which comprises immersion in an aqueous bath brought to boiling point. Table I shows that the surface of the steel, which was already very contaminated after quenching (and thus also before quenching as this was carried out in distilled water), was considerably improved by the pickling treatment used. In this example, the total amount of carbon ($C_{tot}$) on the extreme surface was ascertained using the method of the Ford test.

TABLE I

| Sample | $C_{tot}$ mg/m$^2$ 1 face |
|---|---|
| Continuous naked flame annealing + quenching in boiling water | 0.4 |
| Continuous naked flame annealing + pickling and rinsing | 0.2 |

Table II shows the case of a steel subjected to exposure to air under cover for 48 hours in the summer. The first sample (A) was subjected to a treatment of a continuous nature comprising alkaline degreasing, heating to 700° C. in a conventional radiant tube furnace under $N_2/H_2$, holding for a minute at this temperature, air jet cooling to 500° C., slow cooling for 3 minutes from 500° C. to 400° C., and final atmospheric gas cooling to ambient temperature. The second sample (B) was subjected to a similar treatment, but in which the first cooling was replaced by quenching in water and reheating to 450° C.

The three other samples (C,D,E) were produced in accordance with the method of the invention: heating of the non-degreased sheet in a vertical naked-flame furnace (combustion being controlled in order to produce reducing fumes as a result of insufficient combustion air), rapid cooling, overaging treatment at 450° C. for 1 minute, and final cooling to ambient temperature. The rapid cooling was carried out in three different ways:

(a) jet cooling under atmospheric gas (sample C), causing very slight oxidation;

(b) water treatment (D), causing slight and irregular oxidation;

(c) immersion in an aqueous bath at a temperature approaching boiling (E), causing uniform oxidation to a thickness of 100 to 600 Å.

The samples were then pickled by immersion in a bath of formic acid at a concentration of 1 g/liter for 5 seconds. The corrosion resistance, according to the above-mentioned test, was then evaluated on a scale of 0 (very high resistance) to 10 (flow resistance). The results obtained were as follows:

TABLE II

| Sample | Atmospheric corrosion evaluation after 48 hours |
|---|---|
| A | 10 |
| B | 8 |
| C* | 6 |
| D* | 3 |
| E* | 1 |

*In accordance with the method of the invention.

Thus one can see that the use of a naked flame furnace and the absence of degreasing produce an improvement in each case. This is further enhanced if the treatment includes an oxidising phase, particularly if the oxide produced is uniform and is 100 to 600 Å thick.

We claim:

1. A method of continuous annealing of metal sheet contaminated with rolling oil, comprising the sequential steps of:

(a) heating the contaminated sheet at a temperature higher than the recrystallization temperature of the metal, at least the initial period of heating being in a naked flame furnace;

(b) rapidly cooling the heated sheet, the rapid cooling comprising contacting the sheet with an aqueous medium; and (c) subjecting the cooled sheet to treatment in acid medium.

2. The method of claim 1, in which the naked flame furnace is of the incomplete combustion type.

3. The method of claim 1, further comprising, after the rapid cooling step, subjecting the sheet to a carbon precipitation step at a temperature between 200° and 500° C.

4. The method of claim 1, in which the sheet is subjected to a step of final cooling to ambient temperature after the rapid cooling step.

5. The method of claim 1, in which the acid medium comprises at least one organic acid.

6. The method of claim 1, in which the sheet is subjected to an oxidising step after step (a) and prior to step (c).

7. The method of claim 1, in which the rapid cooling comprises contacting the sheet with at least one aqueous medium selected from the group consisting of an aqueous bath, aqueous jets, and an aqueous mist spray.

8. The method of claim 1, in which the aqueous medium is at a temperature above 75° C.

9. The method of claim 1, in which the sheet is cold-rolled steel sheet.

10. A method of continuous annealing of cold-rolled steel sheet contaminated with rolling oil comprising the sequential steps of:

(a) heating the contaminated sheet to a temperature higher than the recrystallization temperature of the metal, at least the initial period of heating being in an incomplete combustion type naked flame furnace;

(b) rapidly cooling the heated sheet by contacting the sheet with at least one aqueous medium selected from the group consisting of an aqueous bath, aqueous jets, and an aqueous mist spray, said aqueous medium being at a temperature above 75° C.;

(c) effecting carbon precipitation by maintaining the initially cooled sheet at a temperature of between 200° and 500° C.;

(d) final cooling of the initially cooled sheet to ambient temperature; and (e) treating the sheet with an organic acid.

11. The method of claim 1 or claim 10, in which the acid medium comprises formic acid.

* * * * *